US011937750B2

(12) United States Patent
Rukavina

(10) Patent No.: US 11,937,750 B2
(45) Date of Patent: Mar. 26, 2024

(54) FLOOR CLEANER

(71) Applicant: Techtronic Floor Care Technology Limited, Tortola (VG)

(72) Inventor: Douglas M. Rukavina, Concord, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 18/190,740

(22) Filed: Mar. 27, 2023

(65) Prior Publication Data

US 2023/0225579 A1 Jul. 20, 2023

Related U.S. Application Data

(63) Continuation of application No. 17/237,930, filed on Apr. 22, 2021, now Pat. No. 11,612,293.

(60) Provisional application No. 63/015,075, filed on Apr. 24, 2020.

(51) Int. Cl.
*A47L 11/30* (2006.01)
*A47L 11/40* (2006.01)

(52) U.S. Cl.
CPC ..... *A47L 11/30* (2013.01); *A47L 11/4019* (2013.01); *A47L 11/4083* (2013.01)

(58) Field of Classification Search
CPC .. A47L 11/30; A47L 11/4019; A47L 11/4083; A47L 11/4016
See application file for complete search history.

(56) References Cited

U.S. PATENT DOCUMENTS

| | | | |
|---|---|---|---|
| 5,901,406 | A | 5/1999 | Mueller et al. |
| 6,073,300 | A | 6/2000 | Zahuranec et al. |
| 6,154,917 | A | 12/2000 | Zahuranec et al. |
| 6,286,180 | B1 | 9/2001 | Kasper et al. |
| 2003/0014829 | A1 | 1/2003 | Wang |
| 2006/0123583 | A1 | 6/2006 | Parr et al. |

OTHER PUBLICATIONS

International Search Report and Written Opinion for Application No. PCT/US/2021/028673 dated Jul. 9, 2021 (12 pages).

*Primary Examiner* — David Redding
(74) *Attorney, Agent, or Firm* — Michael Best & Friedrich LLP

(57) ABSTRACT

A floor cleaner that includes a recovery tank having a top side, a bottom wall opposite the top side, and a sidewall that extends from the bottom wall and defines a perimeter of the recovery tank, the bottom wall and the sidewall at least partially define a storage volume of the recovery tank. The recover tank further includes an inlet aperture, the inlet aperture adjacent the storage volume and the top side and configured to direct fluid into the storage volume. A baffle wall is connected to the sidewall and the baffle wall faces toward the inlet aperture. An inlet aperture axis extending centrally through the inlet aperture and the inlet aperture axis extends through the baffle wall.

20 Claims, 9 Drawing Sheets

FLOOR CLEANER

CROSS-REFERENCE TO RELATED APPLICATIONS

This application is a continuation of U.S. patent application Ser. No. 17/237,930, filed Apr. 22, 2021, which issued as U.S. Pat. No. 11,612,293 on Mar. 28, 2023, which claims priority to U.S. Provisional Patent Application No. 63/015,075, filed Apr. 24, 2020, the entire contents all of which are hereby incorporated by reference herein.

BACKGROUND

The present disclosure relates to floor cleaners and more particularly to floor cleaners that dispense a fluid onto a surface and recovery and store the fluid in a recovery tank.

SUMMARY

In one embodiment a floor cleaner includes a supply tank configured to store a fluid, a fluid distributor in fluid communication with the supply tank, the fluid distributor operable to dispense the fluid onto a surface being cleaned. The floor cleaner further includes a suction inlet and a suction source in fluid communication with the suction inlet, the suction source operable to generate a suction airflow that is configured to draw the fluid from the surface through the suction inlet. The floor cleaner further includes a recovery tank in fluid communication with the suction inlet and the suction source, the recovery tank configured to receive the fluid and the suction airflow from the suction inlet and separate the suction airflow from the suction inlet. The recover tank includes a top side, a bottom wall opposite the top side, and a sidewall that extends from the bottom wall and defines a perimeter of the recovery tank, the bottom wall and the sidewall at least partially define a storage volume of the recovery tank. An inlet duct is adjacent the top side of the recovery tank. The recovery tank further includes an inlet aperture that faces the bottom wall, the inlet aperture adjacent the storage volume and the top side and configured to direct the fluid from the inlet duct into the storage volume. The inlet aperture is adjacent the sidewall of the recovery tank and the inlet aperture is a longitudinal shaped aperture having an aperture width and an aperture depth, the aperture width being greater than the aperture depth, and the aperture width extends along the sidewall and the aperture depth extends along an inlet duct axis.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
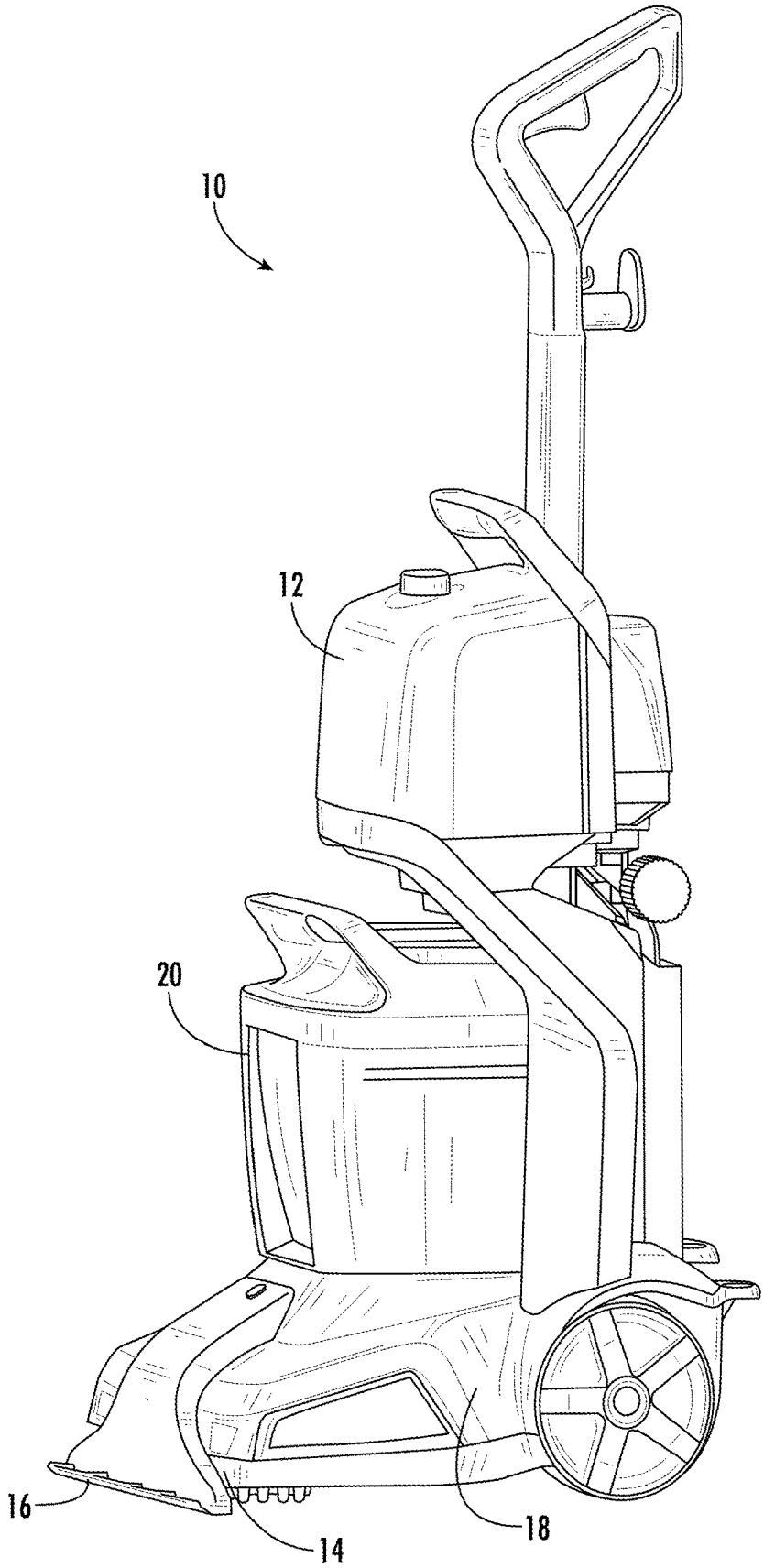
FIG. 1 is a perspective view of a floor cleaner according to one embodiment.

FIG. 1 illustrates a floor cleaner 10. The floor cleaner 10 includes a supply tank 12 and a fluid distributor 14. The supply tank 12 stores a fluid, for example, a cleaning fluid that includes water, detergent, or a mixture of water and detergent. The fluid distributor 14 is in fluid communication with the supply tank 12 and is operable to dispense the fluid from the supply tank 12 onto a surface being cleaned. The floor cleaner 10 further includes a suction inlet 16 and a suction source 18. The suction source 18 is in fluid communication with the suction inlet 16. The suction source 18 includes a motor and a fan in one embodiment that are operable to generate a suction airflow through the suction inlet 16. The suction airflow draws the fluid from the surface being cleaned through the suction inlet 16.

The floor cleaner 10 further includes a recovery tank 20. The recovery tank 20 is in fluid communication with the suction source 18 and the suction inlet 16. The recovery tank 20 receives the fluid and the suction airflow from the suction inlet 16 and the recovery tank 20 separates the fluid from the suction airflow. The fluid is stored in the recovery tank 20 and the suction airflow exits the recovery tank and travels to the suction source 18.

Figure 2:
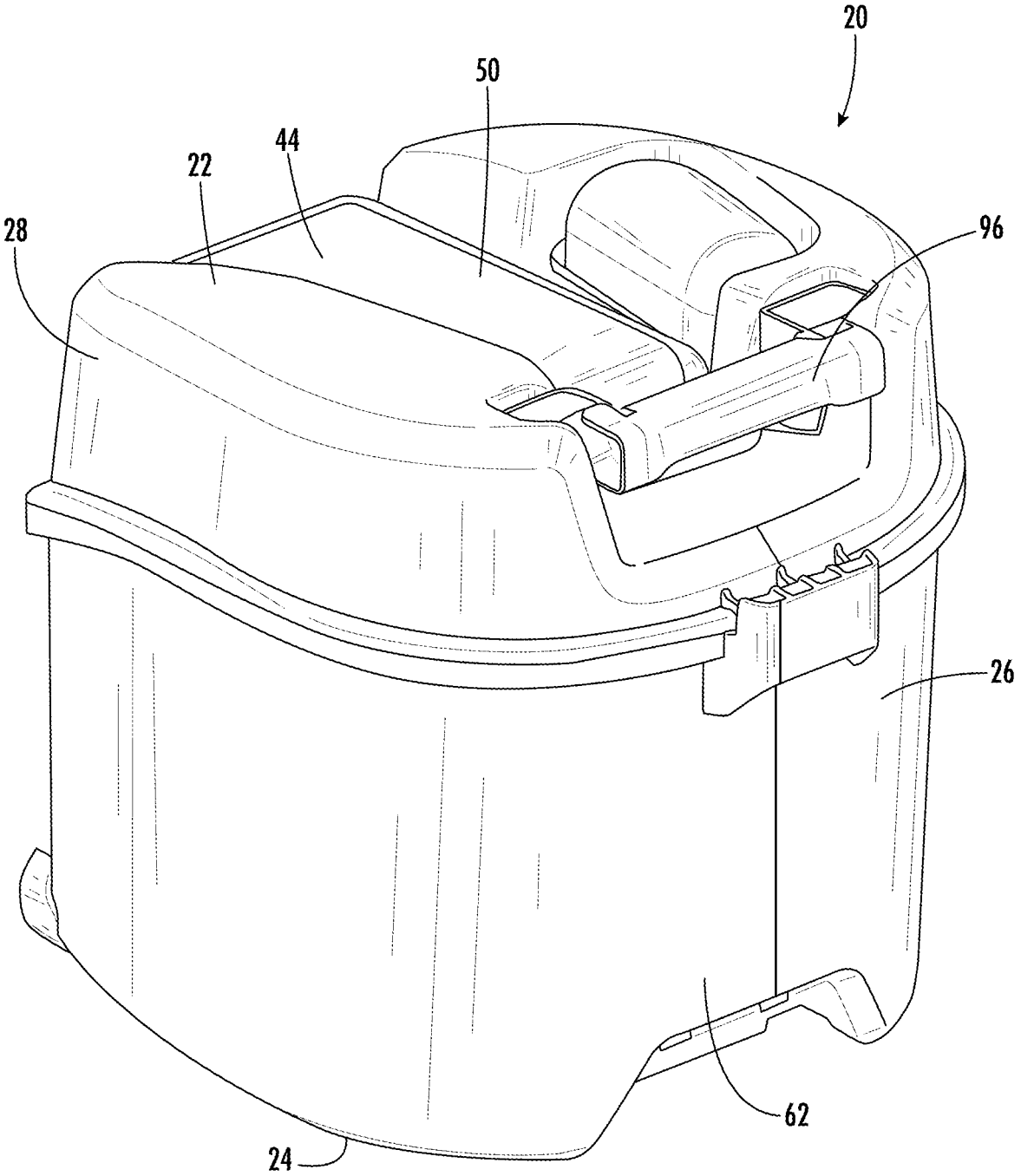
FIG. 2 is a perspective view of a recovery tank of the floor cleaner of FIG. 1.

Referring to FIG. 2, the recovery tank 20 includes a top side 22, a bottom side or wall 24, opposite the top side 22, and a sidewall 26 that extends up from the bottom wall 24. The sidewall 26 defines a perimeter of the recovery tank 20 and together the sidewall 26 and the bottom wall 24 define a storage volume of the recovery tank 20 for the fluid. A lid 28 is removably coupled to the sidewall 26 and the lid 28 defines the top side 22 of the recovery tank 20. In the illustrated embodiment, the lid 28 movable relative to the sidewall 26 between a closed position (FIG. 2) and an open position (FIG. 3) for emptying the storage volume.

Figure 3:
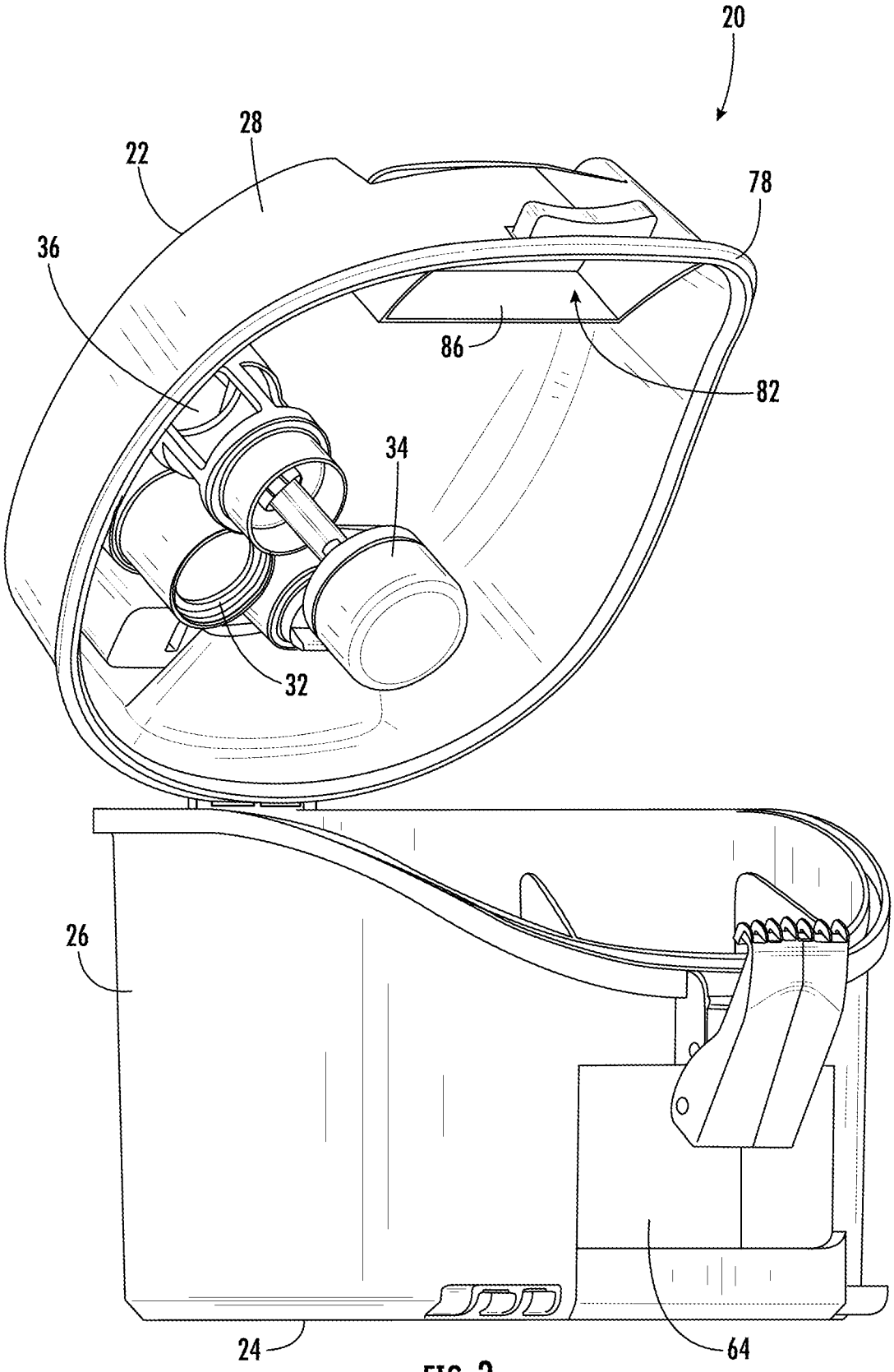
FIG. 3 is a perspective view of the recovery tank of FIG. 2 with a lid in an open position.
Figure 4:
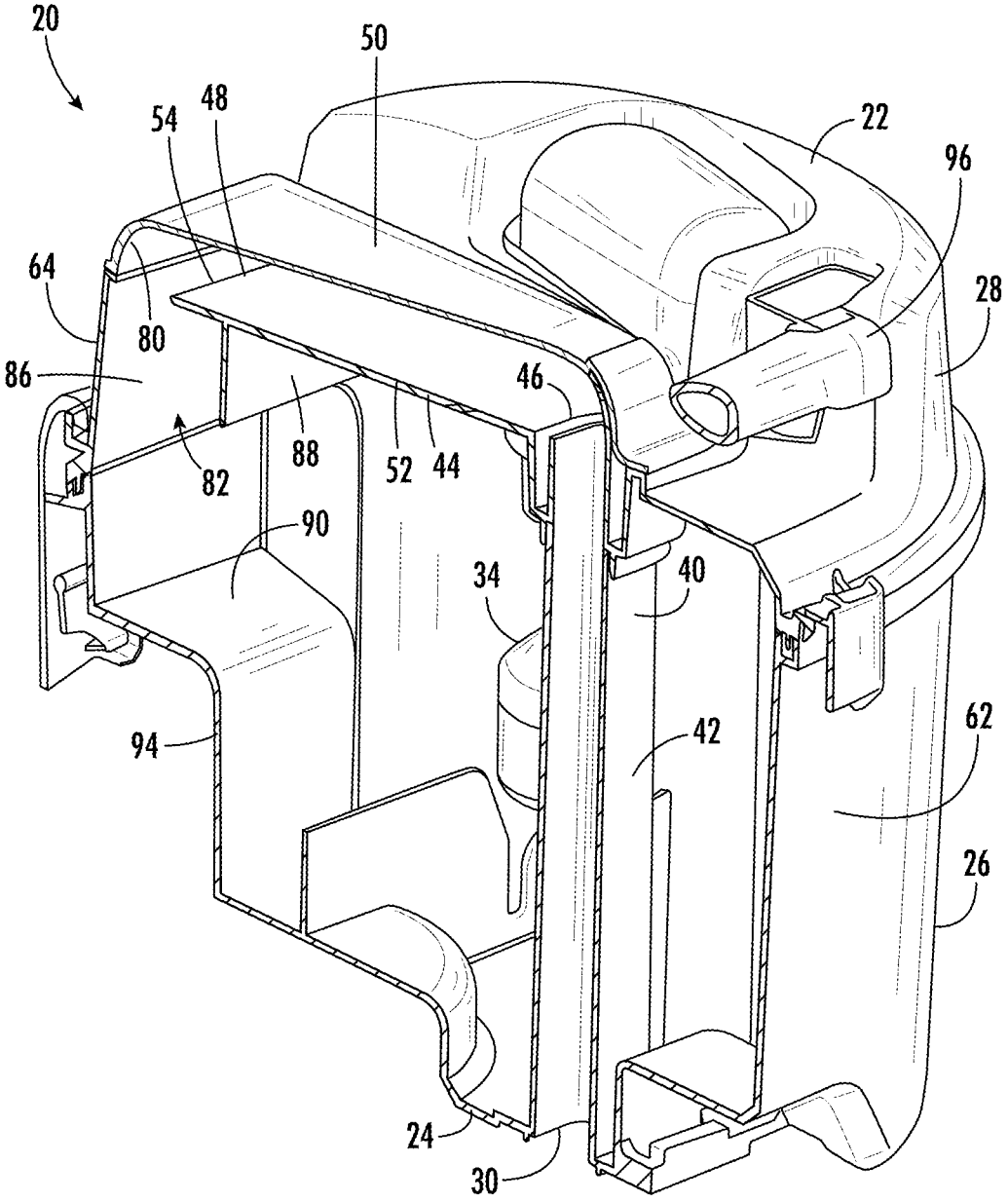
FIG. 4 is a cross-sectional view of the recovery tank of FIG. 2.

Referring to FIGS. 3 and 4, the recovery tank 20 further includes a recovery tank inlet 30 (FIG. 4) and a recovery tank outlet 32 (FIG. 3). A mixture of the fluid and the suction airflow enters the recovery tank 20 through the inlet 30. The fluid is substantially separated from the airflow and retained in the storage volume of the recovery tank 20 while the airflow moves through the outlet 32 and travels to the suction source 18. The recovery tank 20 includes a float 34. The float 34 closes an outlet aperture 36 of the storage volume when the fluid reaches a maximum fill level 38 (FIG. 5).

Figure 5:
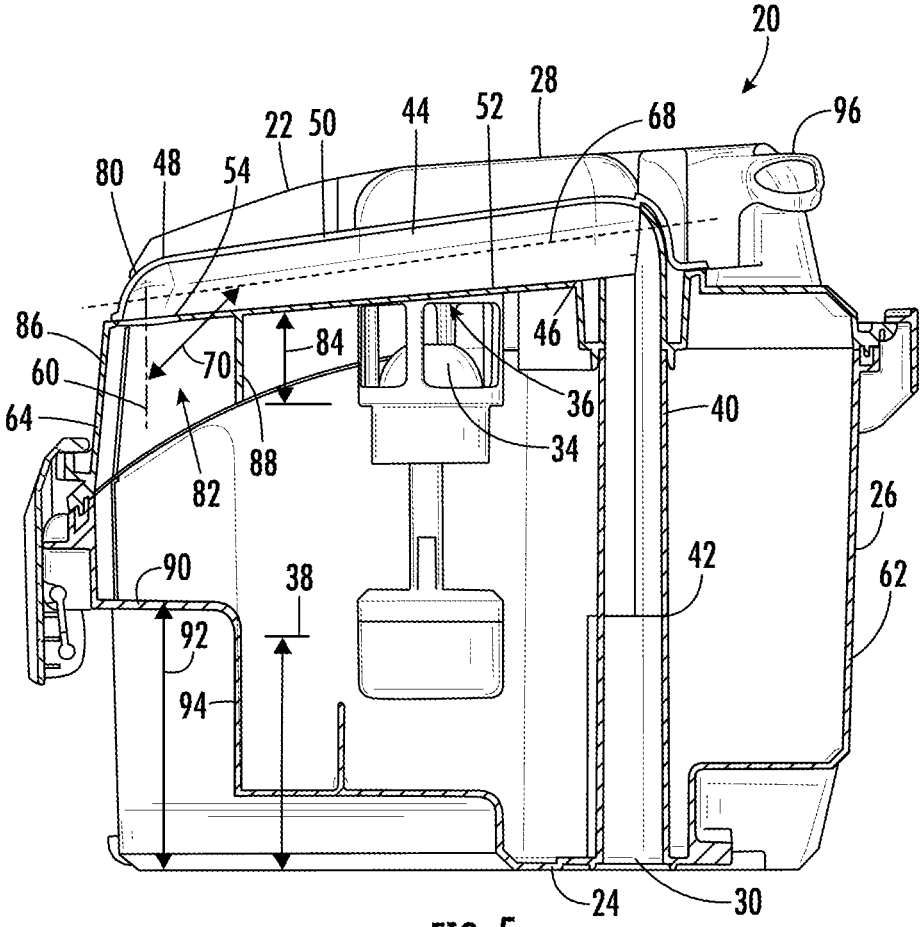
FIG. 5 is an alternative cross-sectional view of the recovery tank of FIG. 2.

With continued reference to FIG. 5, the recovery tank 20 includes an inlet duct 40 that directs the fluid and the suction airflow from the recover tank inlet 30 into the storage volume of the recovery tank 20. In the illustrated embodiment, the inlet duct 40 includes a first portion 42 and a second portion 44. The first portion 42 extends upwardly from the inlet 30 to the lid 28 and to the second portion 44. The second portion 44 of the inlet duct 40 is part of the lid 28 and directs the fluid and the suction airflow into the storage volume of the recovery tank 20.

The second portion 44 of the inlet duct 40 includes a first end 46 and a second end 48. A top wall 50 and a bottom wall 52 of the duct portion 44 both extend between the first end 46 and the second end 48. The bottom wall 52 faces the bottom wall 24 of the recovery tank 20. An inlet aperture 54 to the storage volume extends through the bottom wall 52 adjacent the second end 48 of the duct portion 44. The illustrated bottom wall 52 is angled relative to the bottom wall 24 of the recovery tank 20. In some embodiments, the bottom wall 52 is angled about 1 to 8 degrees relative to the bottom wall 24 of the recovery tank 20 so that the second end 48 of the duct 44 is closer to the bottom wall 24 of the recovery tank 20 than the first end 46 of the duct 44. The angle facilities the flow of fluid toward the inlet aperture 54.

Figure 6:
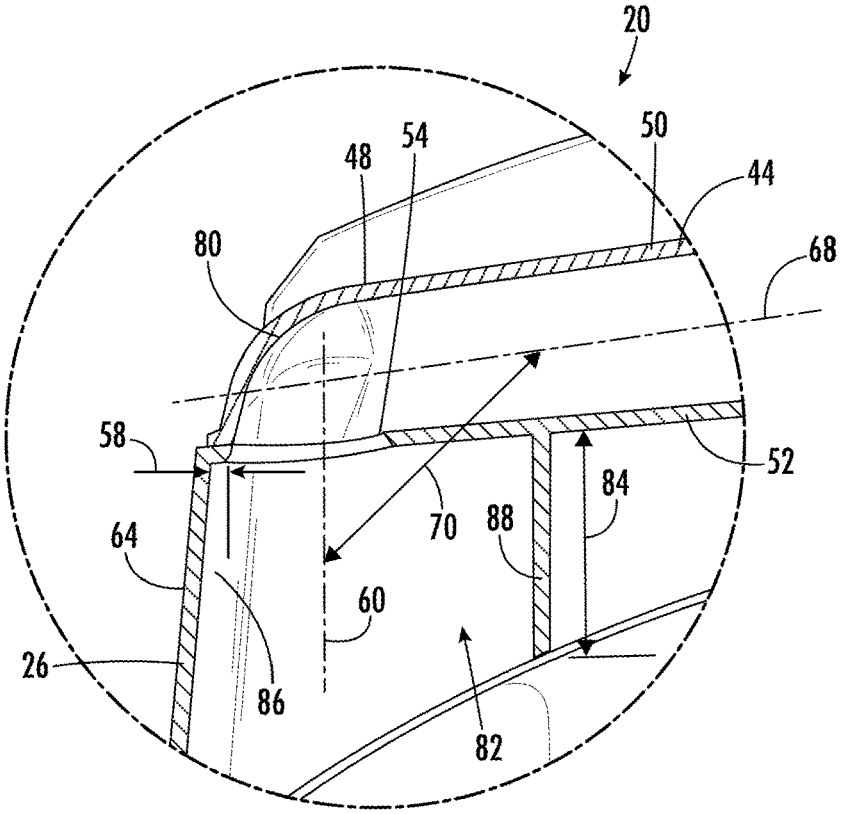
FIG. 6 is an enlarged view of a portion of FIG. 5.

Referring to FIGS. 5 and 6, the inlet aperture 54 is adjacent the top side 22 of the recovery tank 20 and the inlet aperture 54 faces the bottom wall 24 of the recovery tank 20. The inlet aperture 24 is also adjacent the storage volume of the recovery tank 20 such that the fluid and the airflow exit the inlet duct 40 into the storage volume directed by the inlet aperture 54. The inlet aperture 54 is adjacent the sidewall 26 of the recovery tank 20. The inlet aperture 54 is spaced a distance 58 from the sidewall 26 measured generally parallel to the bottom wall 24 of the recovery tank 20 as shown in FIG. 6. In one embodiment, the distance 58 is in a range from 0 to 20 millimeters (mm). In another embodiment, the distance 58 is in a range from 0 to 10 mm. In yet another embodiment, the distance 58 is in a range from 0 to 6 mm. The adjacent and close relationship between the inlet aperture 54 and the sidewall 26 enables the fluid entering the storage volume of the recovery tank 20 to flow through the inlet aperture 54 onto the sidewall 26 to facilitate separation of the fluid from the airflow and inhibit formation of foam from cleaning agents in the fluid. Increasing the distance 58 (e.g., between about 4 mm and 20 mm) tends to increase the impact of the fluid against the sidewall 26 absorbing energy of the incoming flow that facilitates separation of the fluid from the airflow. It has been found that the distance 58 may be selected to provide desired fluid and airflow separation while inhibiting or minimizing the formation of foam. An inlet aperture axis 60 extends centrally through the inlet aperture 54 as shown in FIG. 6. In some embodiments, the inlet aperture axis 60 is perpendicular to the bottom wall 24 of the recovery tank 20 plus or minus 20 degrees.

The duct portion 44 is adjacent the top side 22 of the recovery tank 20 and extends in a direction from a first or front side 62 of the sidewall 26 to a second or back side 64 of the sidewall 26 opposite the front side 62. The top wall 50 of the duct portion 44 is transparent or semitransparent such that the duct portion 44 is visible to a user during operation of the floor cleaner and the user can see the fluid traveling through the duct portion 44 and through the inlet aperture 54 into the storage volume of the recovery tank 20.

Figure 8:
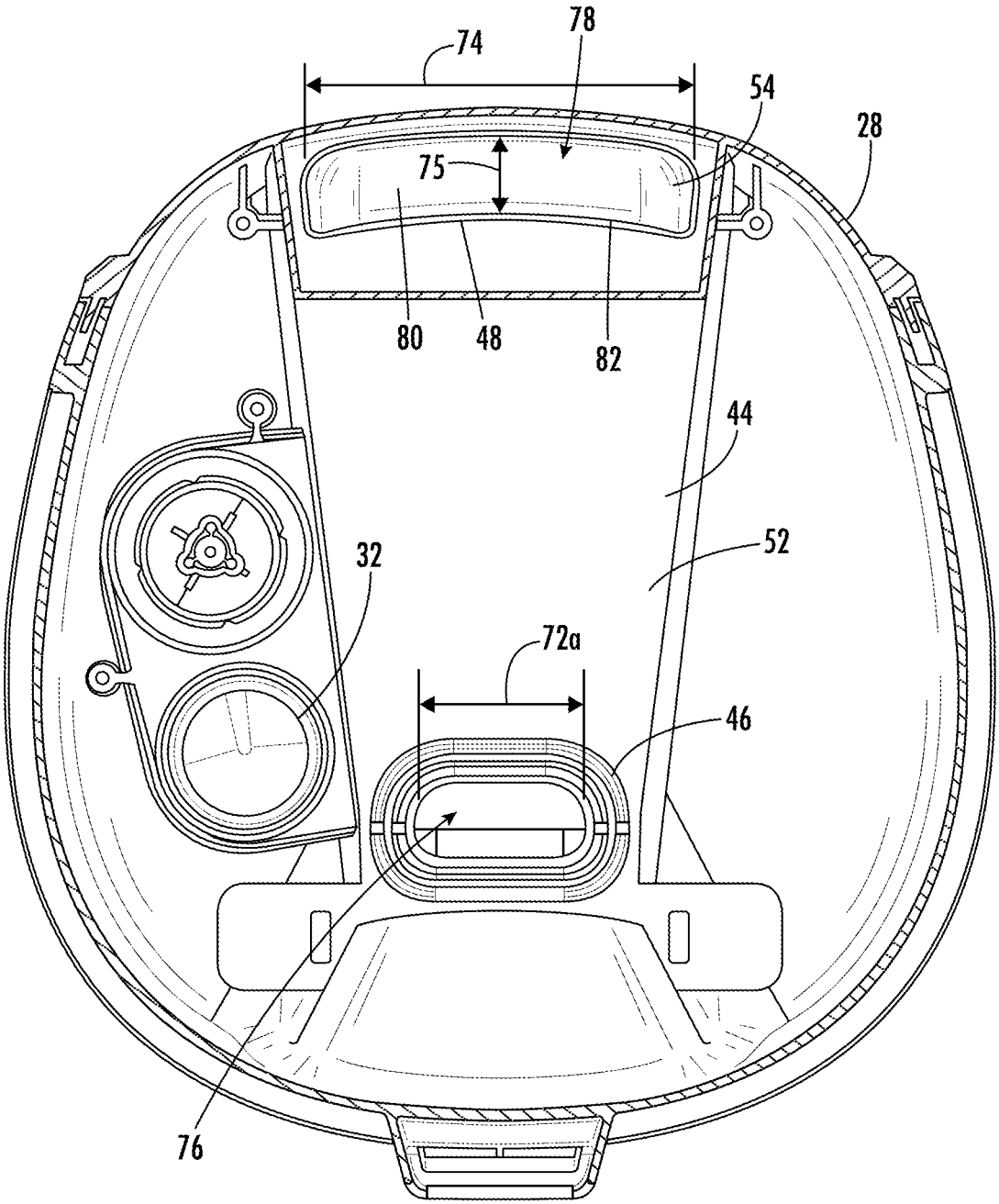
FIG. 8 is a bottom side view of the lid of FIG. 7.
Figure 9:
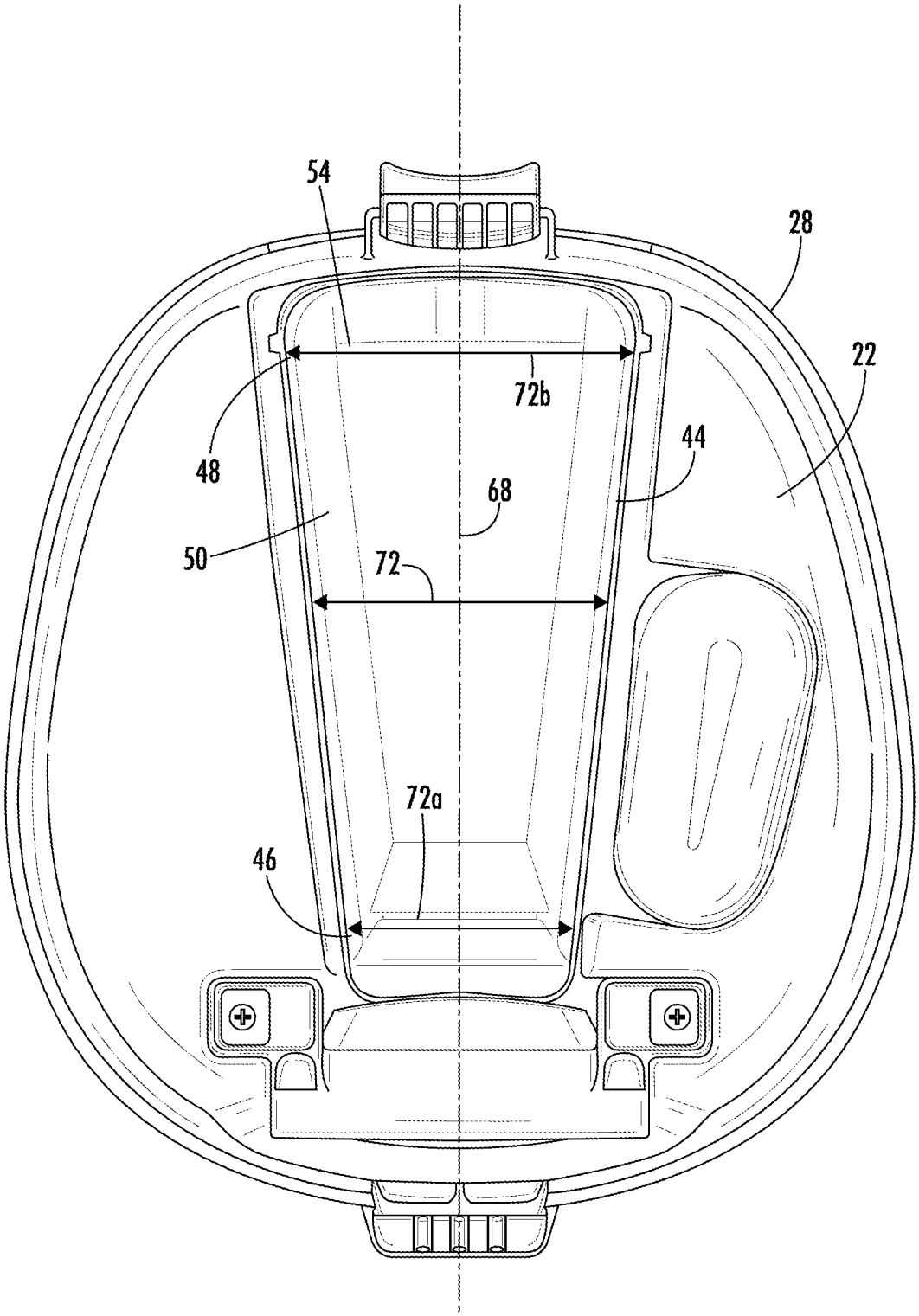
FIG. 9 is a top side view of the lid of FIG. 7.

An inlet duct axis 68 extends centrally through the duct portion 44 along a length of the duct portion 44. In the illustrated embodiment, the axis 68 is angled relative to the bottom wall 24 of the recovery tank 20 due to the angle of the bottom wall 52 of the duct portion 44 discussed above. The inlet duct axis 68 is at an angle 70 with the respect to the inlet aperture axis 60. In some embodiments, the angle 70 is in a range from 85 degrees to 135 degrees. In other embodiments, the angle 70 is in a range from 90 degrees to 110 degrees. Referring to FIG. 9, a width 72 of the duct portion 44 is measured perpendicular to the axis 68. The width 72 increase in a direction toward the inlet aperture 54 along the axis 68. The width 72 widens from a first width 72*a* at the first end 46 to a second width 72*b* near the inlet aperture 54 and the second end 48. The inlet aperture 54 is a longitudinal shaped aperture having a width 74 and a depth 75 (FIG. 8), where the width 74 extends along the sidewall 26 and the depth 75 extends along the inlet duct axis 68. The width 74 of the inlet aperture 54 generally corresponds to the second width 72*b*. In one embodiment, the width 74 of the inlet aperture 54 is equal to the width 72*b*. In some embodiments, width 72*b* is between 1.25 and 3 times width 72*a*, and may be between 1.5 and 2.5 times wider than the width 72*a* in such embodiments. Increased width 74 of the inlet aperture 54 provides a wider flow surface along the sidewall 26 facilitating separation of the fluid and the airflow and inhibiting formation of foam. In one embodiment, at least a portion of the width 74 extends along the sidewall 26 for a distance greater than the depth 75. In one embodiment, at least a portion of the width 74 extends along the sidewall 26 for a distance from 1.1 to 12 times the depth 75, and may be from 1.5 to 12 times the depth 75. In one embodiment, at least a portion of the width 74 extends along the sidewall 26 for a distance from 2 to 6 times the depth 75, and may be from 3 to 5 times the depth 75. In one embodiment, the inlet aperture 54 is a longitudinal shaped aperture having at least a portion of the width 74 extending along the sidewall 26 a constant distance from the sidewall 26.

Figure 10:
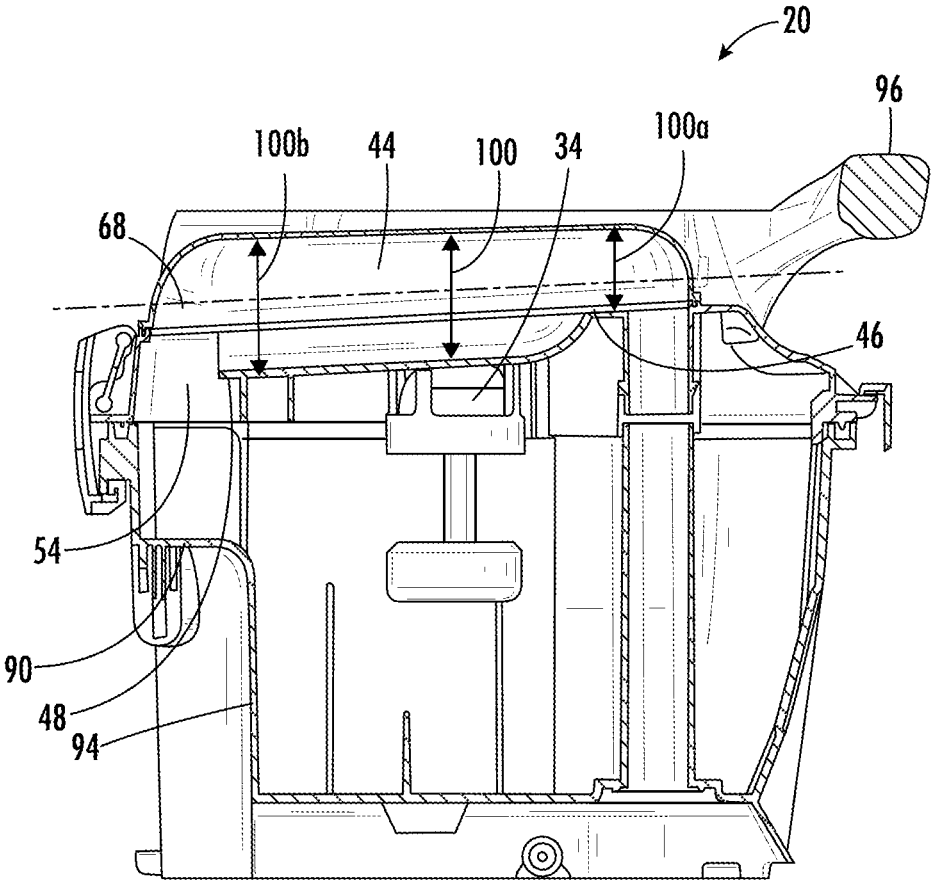
FIG. 10 is a cross-sectional view through a recovery tank according to an alternative embodiment.

Referring to FIG. 10, a height 100 of the duct portion 44 is measured perpendicular to the axis 68. The height 100 increases in a direction toward the inlet aperture 54 along the axis 68. The height 100 increases from a first height 100*a* at the first end 46 to a second height 100*b* near the inlet aperture 54 and the second end 48. In one embodiment, the height 100 gradually increases from the first height 100*a* to the second height 100*b* between the first end 46 and the second end 48. In another embodiment, the height 100 increases from the first height 100*a* to the second height 100*b* via one or more steps. In the embodiment illustrated in FIG. 10, the height increases by both a step 98 and a gradual increase downstream of the step. In one embodiment, the height 100*b* is between 1.03 and 2 times the height 100*a*. In another embodiment, the height 100*b* is between 1.3 and 1.8 times higher than the height 100*a*. In yet another embodiment, the height 100*b* is between 1.03 and 1.3 times higher than the height 100*a*.

Because of the increasing width 72 and height 100 along the axis 68, the cross-sectional area of the duct portion 44 also increases in the same direction toward the inlet aperture 54 along the axis 68. The increasing cross-sectional area reduces the flow velocity of the fluid and the suction airflow in the duct portion 44. Referring to FIG. 8, the duct portion 44 has a first cross-sectional area 76 at the first end 46 of the duct portion 44 and a second cross-sectional area 78 at the second end 48 of the duct portion 44 that is greater than the cross-sectional area 76. The second cross-sectional area 78 is directly adjacent the inlet aperture 54. In one embodiment, the area of the inlet aperture 54 is equal to the second cross-sectional area 78. In some embodiments the second cross-sectional area 78 is between 1.25 and 4 times the first cross-sectional area 76, and may be between 2 and 3 times the first cross-sectional area 76 in such embodiments.

Referring to FIG. 6, the duct portion 44 includes a deflecting surface 80. The deflecting surface 80 is adjacent the inlet aperture 54 and facilitates a change in direction of the flow of fluid and the airflow from along the duct axis 68 to along the inlet aperture axis 60. In the illustrated embodiment, the deflecting surface 80 is curved and generally tangent to the top wall 50 of the duct portion 44.

Figure 7:
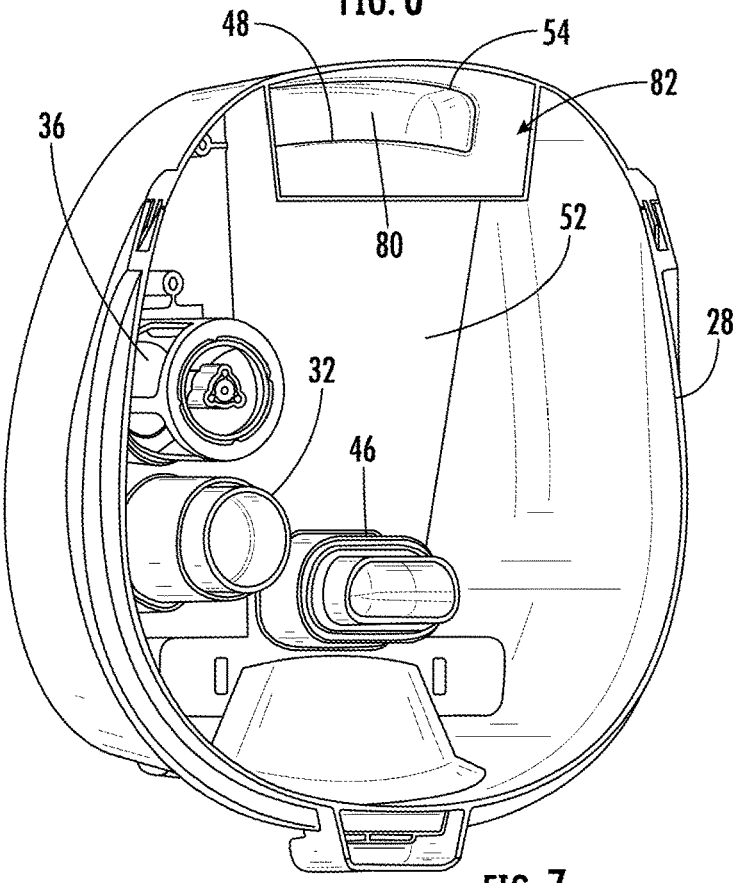
FIG. 7 is a perspective view of the lid of the recovery tank of FIG. 2.

Referring to FIGS. 5 and 7, a ducted channel 82 surrounds the inlet aperture 54 inside the recovery tank 20. The ducted channel 82 facilitates downward flow of the fluid and the airflow and inhibits flow in lateral or horizontal directions. The ducted channel 82 extends toward the bottom wall 24 of the recovery tank 20 and has a length 84. In some embodiments, the length 84 is at least 5 mm. In such embodiments, the length 84 may be greater than 15 mm and in yet other embodiments greater than 25 mm. The illustrated ducted channel 82 is formed by a portion 86 of the sidewall 26 and a portion 88 of the lid 28.

Referring to FIG. 5, the recovery tank 20 further includes a baffle wall 90. The baffle wall 90 faces toward the inlet aperture 54 and the inlet aperture axis 60 extends through the baffle wall 90. In some embodiments, the axis 60 is generally perpendicular to the baffle wall 90. In some embodiments, the baffle wall 90 is angled or slanted relative to the bottom wall 24 of the recovery tank 20. For example, the baffle wall 90 may be angled 1 to 15 degrees, including 2 to 10 degrees, relative to the bottom wall 24 to promote fluid drainage off of the baffle wall 90 toward the bottom wall 24, which may also inhibit the formation of foam in the recovery tank 20. The baffle wall 90 is spaced a baffle height 92 measured from the bottom wall 24 as shown in FIG. 5. The baffle wall 90 is positioned to be greater than a predetermined fluid level in the tank, such that when fluid level is lower than the predetermined level, the fluid entering the tank through the inlet aperture 54 engages the baffle wall 90 before engaging the surface of the fluid, inhibiting formation of foam in the recovery tank 20. In one embodiment, the baffle height 92 is selected to be greater than the fluid height at 50% of the maximum fill level 38. In a preferred embodiment, the baffle height 92 is greater than the maximum fill level 38 of the recovery tank 20. In some embodiments, the baffle height 92 is about 2 mm to about 30 mm greater than the maximum fill level 38, and between about 5 mm to about 15 mm greater than the maximum fill level 38 in some embodiments. In the illustrated embodiment, the baffle wall 90 is formed by a recess 94 in the sidewall 26. The recess 94 forms a lifting handle 55 for the recovery tank 20 that can be used in combination with a handle 96 of the lid 28. In one embodiment, the handle 55 includes a grip portion 57 disposed adjacent the recess 94 for a user's fingers to engage when using the handle 55.

Although the invention has been described in detail with reference to certain preferred embodiments, variations and modifications exist within the scope and spirit of one or more independent aspects of the invention as described.

What is claimed is:

1. A floor cleaner comprising:

a supply tank configured to store a fluid;

a fluid distributor in fluid communication with the supply tank, the fluid distributor operable to dispense the fluid onto a surface being cleaned;

a suction inlet;

a suction source in fluid communication with the suction inlet, the suction source operable to generate a suction airflow that is configured to draw the fluid from the surface through the suction inlet; and a recovery tank in fluid communication with the suction inlet and the suction source, the recovery tank configured to receive the fluid and the suction airflow from the suction inlet and separate the suction airflow from the fluid, the recover tank including:

a top side, a bottom wall opposite the top side, a sidewall that extends from the bottom wall and defines a perimeter of the recovery tank, the bottom wall and the sidewall at least partially define a storage volume of the recovery tank, an inlet duct having an inlet aperture configured to direct the fluid from the inlet duct into the storage volume, a baffle wall connected to the sidewall and the baffle wall facing toward the inlet aperture, and an inlet aperture axis extending centrally through the inlet aperture, wherein the inlet aperture axis extends through the baffle wall.

2. The floor cleaner of claim 1, wherein the inlet aperture is adjacent the sidewall of the recovery tank and the inlet aperture is a longitudinal shaped aperture having an aperture width and an aperture depth, the aperture width being greater than the aperture depth, wherein the aperture width extends along the sidewall and the aperture depth extends along an inlet duct axis.

3. The floor cleaner of claim 2, wherein at least a portion of the aperture width extends along the sidewall a constant distance from the sidewall.

4. The floor cleaner of claim 2, wherein the aperture width is transverse to the inlet duct axis.

5. The floor cleaner of claim 2, wherein the aperture width corresponds to the inlet duct adjacent the inlet aperture.

6. The floor cleaner of claim 2, wherein the aperture width is from 1 to 12 times the aperture depth.

7. The floor cleaner of claim 1, wherein the inlet duct is adjacent the top side of the recovery tank configured to direct a flow velocity of the fluid and the suction airflow along the sidewall downstream of the inlet duct.

8. The floor cleaner of claim 1, wherein the inlet aperture faces the bottom wall.

9. The floor cleaner of claim 1, wherein the inlet aperture is disposed above the baffle wall in a direction from the bottom wall to the top side.

10. The floor cleaner of claim 1, wherein the inlet aperture is spaced from the sidewall a distance measured parallel to the bottom wall, the distance in a range from 0 millimeters to 20 millimeters.

11. The floor cleaner of claim 1, wherein the inlet aperture forms an outlet of the inlet duct.

12. The floor cleaner of claim 1, further comprising a ducted channel that surrounds the inlet aperture inside of the recovery tank and the ducted channel extends toward the bottom wall, wherein the ducted channel has a length measured from the inlet aperture toward the bottom wall, and wherein the length is at least 5 millimeters.

13. The floor cleaner of claim 1, wherein the recovery tank includes a lid removably coupled to the sidewall, and wherein the lid includes the inlet duct.

14. The floor cleaner of claim 13, wherein the inlet duct includes a first portion that extends from the bottom wall and a second portion formed in the lid.

15. The floor cleaner of claim 1, wherein the inlet duct has a cross-sectional area that increases in a direction toward the inlet aperture configured to reduce a flow velocity of the fluid and the suction airflow in the inlet duct.

16. The floor cleaner of claim 1, wherein the inlet duct forms an axis that extends centrally through the inlet duct along a length of the inlet duct, wherein the inlet duct has a width measured perpendicular to the inlet duct axis, and wherein the width increases in a direction toward the inlet aperture along the inlet duct axis.

17. The floor cleaner of claim 1, wherein the inlet duct has a height that increases in a direction toward the inlet aperture.

18. The floor cleaner of claim 1, wherein the sidewall has a first side and a second side opposite the first side, wherein the inlet duct extends in a direction from the first side toward the side.

19. The floor cleaner of claim 1, wherein the baffle wall is spaced a baffle height measured from the bottom wall, the baffle height is greater than 50% of a maximum fill level of the storage volume measured from the bottom wall.

20. The floor cleaner of claim 1, wherein the baffle height is greater than the maximum fill level in a range from 2 millimeters to 30 millimeters.

* * * * *